United States Patent [19]

Ramer

[11] Patent Number: 4,674,766

[45] Date of Patent: Jun. 23, 1987

[54] ALPINE-TOURING SKI BINDING

[75] Inventor: Paul C. Ramer, Golden, Colo.

[73] Assignee: Alpine Research, Inc., Golden, Colo.

[21] Appl. No.: 703,730

[22] Filed: Feb. 21, 1985

[51] Int. Cl.[4] ..... A63C 9/00

[52] U.S. Cl. ..... 280/614; 280/618

[58] Field of Search ..... 280/617, 636, 613, 614, 280/615, 618

[56] References Cited

U.S. PATENT DOCUMENTS

| | | | |
|---|---|---|---|
| 2,686,059 | 8/1954 | Whitaker | 280/614 |
| 3,675,938 | 7/1972 | Sigl | 280/636 |
| 4,002,354 | 1/1977 | Ramer | 280/614 |
| 4,367,885 | 1/1983 | Ramer | 280/614 |
| 4,392,666 | 7/1983 | Ramer | 280/614 |
| 4,500,108 | 2/1985 | Johnson, III | 280/614 |
| 4,513,988 | 4/1985 | Svoboda | 280/615 |
| 4,586,727 | 5/1986 | Andrieu et al. | 280/636 |

FOREIGN PATENT DOCUMENTS

| | | | |
|---|---|---|---|
| 35951 | 9/1981 | European Pat. Off. | 280/614 |
| 2757553 | 6/1979 | Fed. Rep. of Germany | 280/614 |
| 2490099 | 3/1982 | France | 280/615 |
| 2512683 | 3/1983 | France | 280/615 |

*Primary Examiner*—John J. Love
*Assistant Examiner*—Eric D. Culbreth
*Attorney, Agent, or Firm*—Gary M. Polumbus

[57] ABSTRACT

The alpine-touring ski binding of the present invention utilizes a boot plate on which the ski boot is releasably mounted with the boot plate being pivotally connected to a toe piece for selective pivotal movement about a transverse axis passing through the toe piece and includes a heel piece for releasably securing the heel end of the boot plate to the ski. A unique system is employed on the boot plate so that when the heel piece is inoperative and allows the trailing end of the boot piece to be elevated as during cross-country skiing, an elevator plate on the boot plate can be deployed to selectively determine the limits of movement of the boot plate by preventing the boot plate from returning completely to a parallel relationship with the ski. An elevator plate is also provided on the heel piece for the same purpose.

6 Claims, 15 Drawing Figures

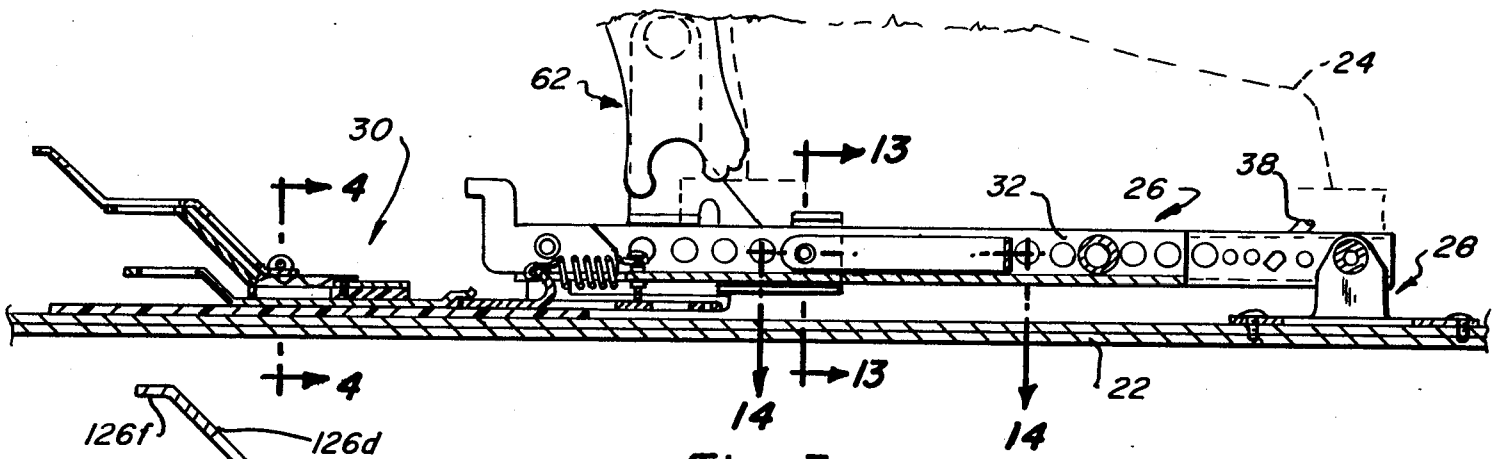
Fig_3
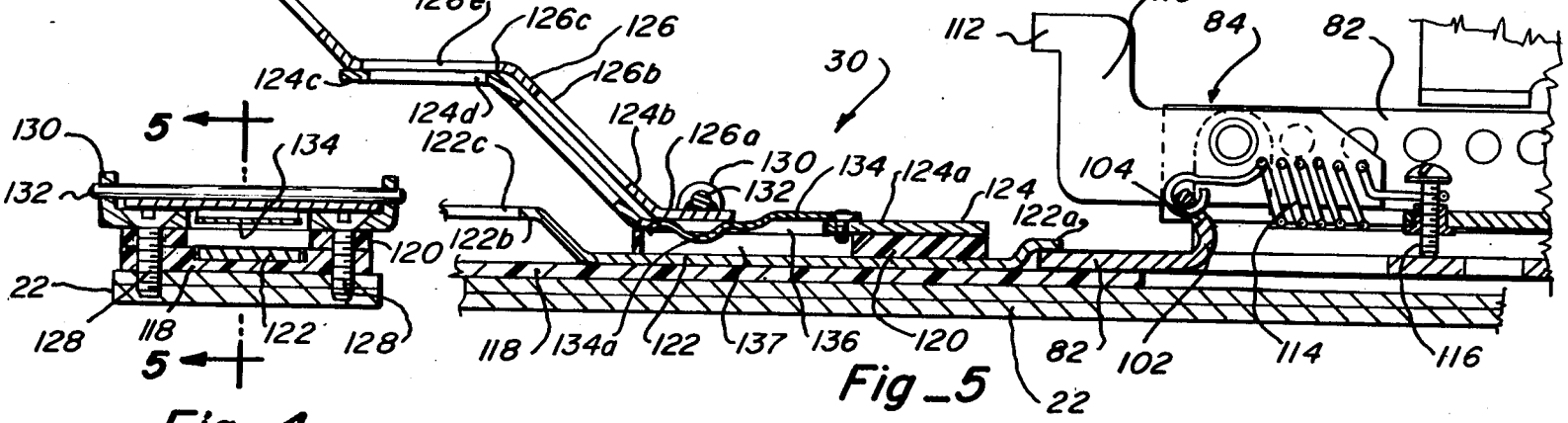
Fig_5
Fig_4

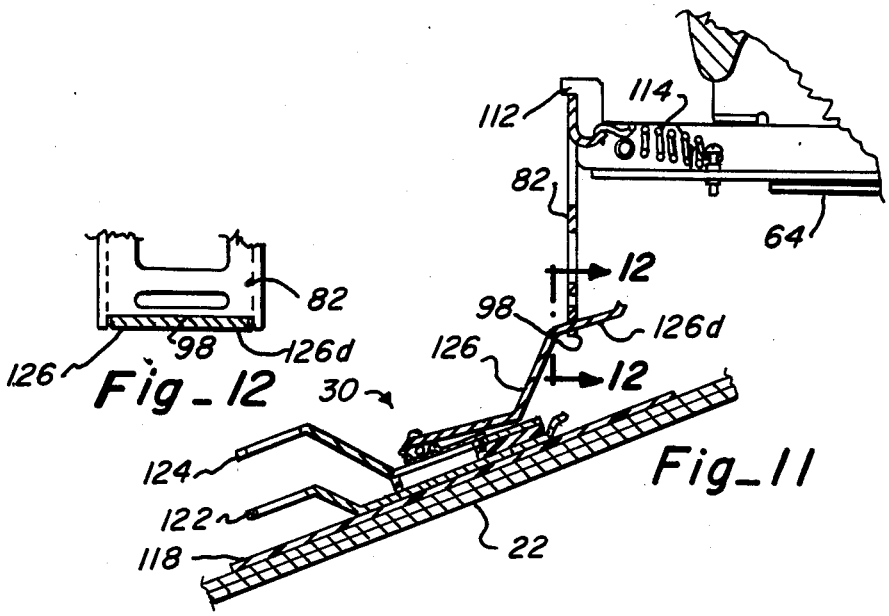
Fig_11
Fig_12
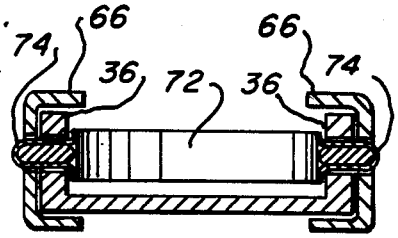
Fig_13
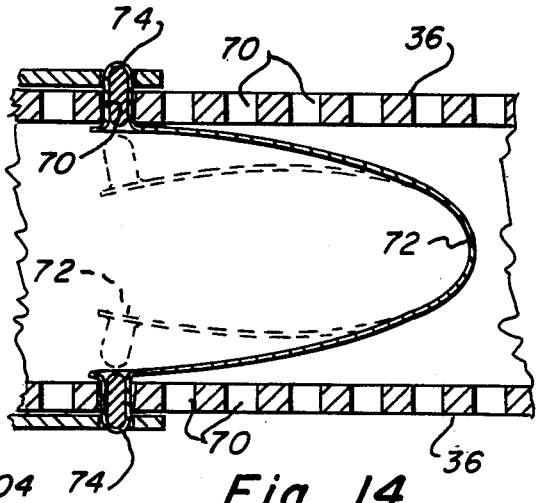
Fig_14
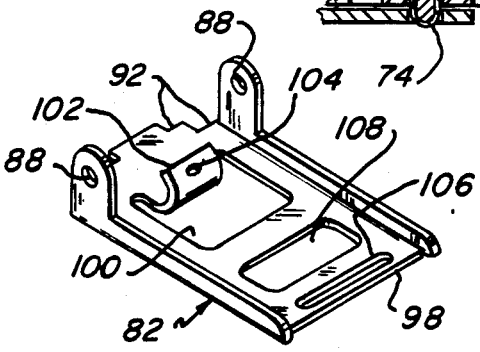
Fig_15

ALPINE-TOURING SKI BINDING

BACKGROUND OF THE INVENTION

1. Field of the Invention

The present invention relates generally to ski equipment, and more particularly, to a snow ski binding adapted for use in both alpine and cross-country skiing.

2. Description of the Prior Art

Ski bindings have evolved from a very crude form wherein a strap was used to secure the skier's boot to the ski to more sophisticated bindings which automatically release the skier from the ski when certain relative forces are applied to the skier or ski. These latter bindings have been referred to as release bindings and are intended to minimize the risk of injury to the skier. Release bindings have been directed toward alpine skiing and have not been concerned with cross-country skiing, which is sometimes referred to as touring, which branch of skiing has been rapidly increasing in popularity. Bindings for cross-country skiing have not in the past varied materially and have all utilized some form of anchor for the toe of the skier's boot so that the the heel of the skier's boot is free to lift as occurs in normal walking motions.

The recent increase in cross-country skiing, however, has brought about a need for a binding which is readily convertible between use as an alpine skiing release-type binding and a cross-country or touring binding. The present invention has been developed to satisfy this need.

OBJECTS OF THE INVENTION

It is an object of the present invention to provide a new and improved binding adapted for use both in alpine and cross-country skiing.

It is another object of the present invention to provide a new and improved binding which has independent systems for releasing the skier's heel in the vertical and lateral directions.

It is another object of the present invention to provide a plate-type binding for use in alpine skiing as well as cross-country skiing wherein a quick adjustment of the binding provides for different sizes of boots.

It is another object of the present invention to provide a binding for use in both alpine skiing and cross-country skiing wherein the heel of the skier's boot can be selectively secured to the ski or allowed to pivot freely away from the ski but returned to any one of a plurality of elevated positions above the ski to facilitate ease of cross-country skiing and climbing.

SUMMARY OF THE INVENTION

The ski binding of the present invention basically consists of a boot plate, which is selectively securable to the bottom of a ski boot, and toe and heel pieces which are securely mountable on a ski to releasably retain the boot plate on the ski.

The boot plate is releasably securable to the toe piece in a manner such that the plate can pivot about an axis extending through the toe piece transversely of the ski with the connection being releasable upon the application of predetermined lateral forces to the skier's foot and consequently the boot plate itself. The opposite end of the boot plate is selectively secured to the ski by the heel piece but can be easily manually released so that the heel portion of the plate can be lifted and thereby pivoted about the transverse axis through the toe piece when the binding is used in a cross-country mode. When the heel piece is used to retain the boot plate adjacent to the top of the ski, as in alpine skiing, it is adapted to allow the boot plate to be released laterally upon application of a predetermined force for safety purposes.

The boot plate is uniquely designed to have a heel carriage mounted thereon which is selectively positionable along the length of the boot plate to accommodate the various-sized boots of skiers that might be using the binding. The heel carriage has a conventional vertical heel release system for retaining the heel of the skier's boots on the boot plate unless and until a predetermined vertical force is applied to the heel of the boot which causes it to be released from the heel release mechanism.

A unique feature of the boot plate is an elevator plate that is selectively stowed beneath the heel portion or trailing end of the plate and can be pivoted into a deployed position wherein it extends perpendicularly and downwardly away from the trailing end of the boot plate so as to prevent the boot plate from being returned to the top surface of the ski. When the binding is placed in this mode, it is easier for the skier to walk up hills as his foot can only drop to a horizontal position even though the ski itself is angled upwardly. An overcenter spring system is designed to yieldingly retain the elevator plate in either its stowed or deployed positions for reliable operation of the binding.

The heel piece includes a swing plate that is adapted to be moved between a position wherein it is totally confined on the heel piece to a position wherein it underlies the trailing end of the boot plate and in this latter position can cooperate with the elevator plate in establishing distinct lowermost positions that the trailing end of the plate is allowed to return to primarily to facilitate ease of climbing when utilizing the binding in a cross-country mode. The heel piece is also designed to cooperate with the elevator plate to hold the heel portion of the boot plate in an elevated position which is sometimes desirable when climbing steep inclines.

Other aspects, features, and details of the present invention can be more completely understood by reference to the following detailed description of a preferred embodiment, taken in conjunction with the drawings, and from the appended claims.

BRIEF DESCRIPTION OF THE DRAWING

FIG. 3 is a full section taken along line 3—3 of FIG. 1 with the boot shown in dotted line.

FIG. 4 is an enlarged vertical section taken along line 4—4 of FIG. 3.

FIG. 5 is a vertical section taken along line 5—5 of FIG. 4.

FIGS. 6, 7, 9, and 11 are fragmentary partial sections illustrating various operation features of the binding of the present invention.

FIG. 12 is a fragmentary view taken along line 12—12 of FIG. 11.

FIG. 13 is a section taken along line 13—13 of FIG. 3.

FIG. 14 is a section taken along line 14—14 of FIG. 3.

FIG. 15 is a perspective view of the elevator plate utilized in the binding of the present invention.

DESCRIPTION OF THE PREFERRED EMBODIMENT

Figures 1, 2:
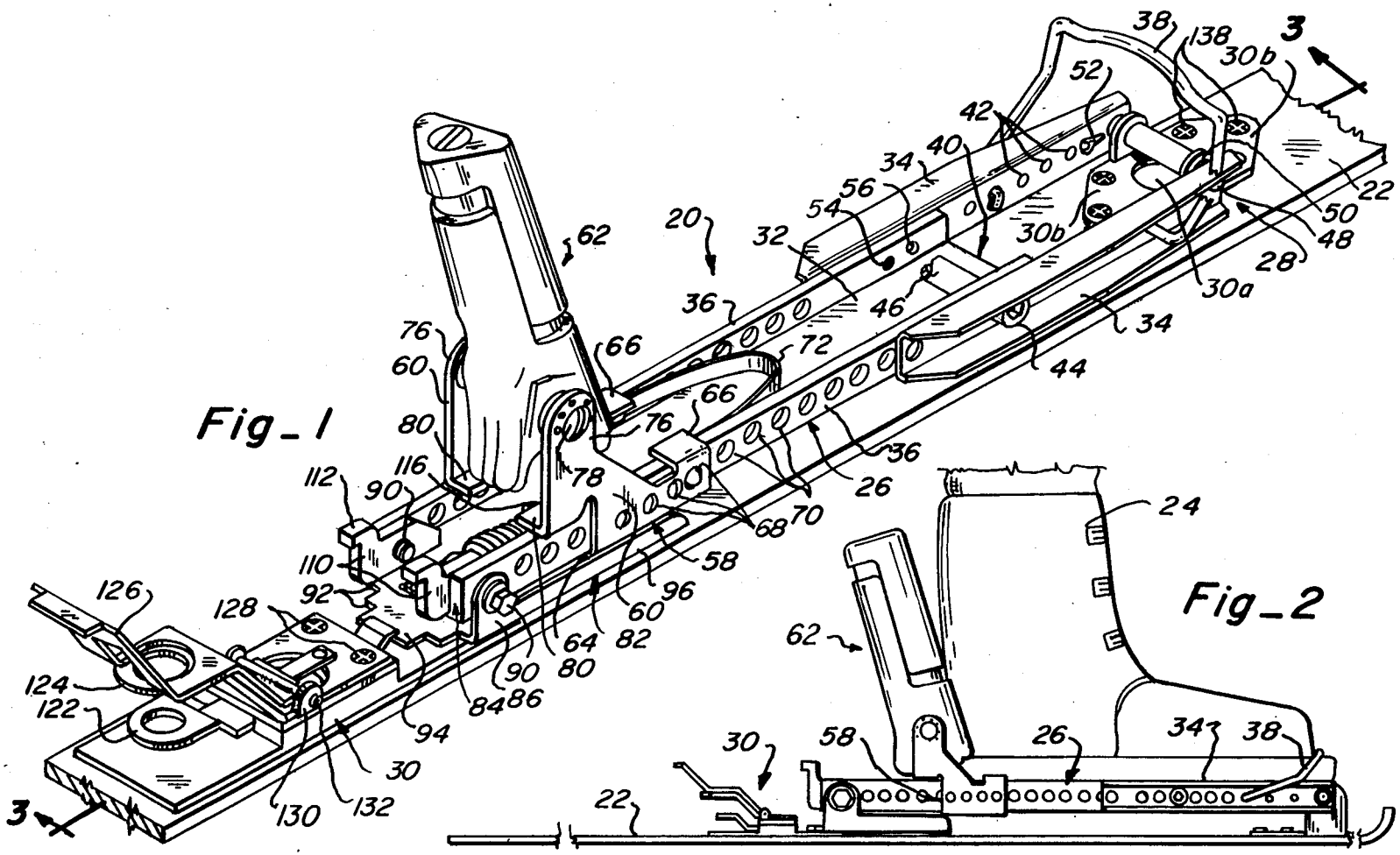
FIG. 1 is a fragmentary perspective view of a ski having the alpine-touring binding of the present invention mounted thereon.
FIG. 2 is a side elevational view of the ski illustrated in FIG. 1 with parts removed illustrating the binding of the present invention mounted on the ski with a boot releasably retained in the binding.
Figure 8:
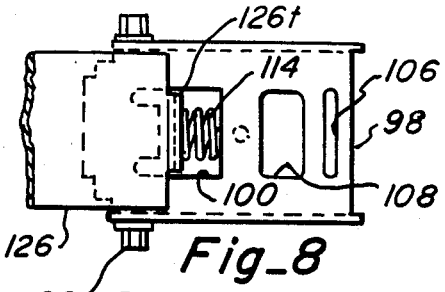
FIG. 8 is a fragmentary view taken along line 8—8 of FIG. 7.

Referrring first to FIGS. 1 and 2, the binding 20 of the present invention is shown mounted on a ski 22 with a ski boot 24 (FIG. 2) secured to the binding. The binding consists of three basic component parts, a boot plate 26, a toe piece 28, and a heel piece 30.

Referring first to the boot plate 26, it can be seen to include a main body 32 and a pair of spring bar members 34 anchored to the sides 36 of the main body and protruding forwardly therefrom a preselected distance. The main body 32, which is preferably made of aluminum, polycarbonate, or the like, is channel shaped in configuration with the channel opening upwardly.

A stiff U-shaped wire 38 is anchored to the spring bars 34 at a location immediately in front of the leading end 40 of the main body portion 32 and this stiff wire is adapted to extend over and across the lip provided on the toe of a conventional hiking boot or ski boot 24 to selectively retain the toe of the boot in secured tight relationship with the boot plate. A set of anchor holes 42 are provided in the spring bars 34 to give an added means for adjusting the wire 38 relative to the boot.

The spring bars 34 are mainly anchored to the sides of the main body portion 32 of the boot plate by bolt-type fasteners 44 threaded into a barrel nut 46 extending between the sides of the main body.

Near the forward most end of each spring bar member 34, an inwardly opening cup 48 is formed in the spring bar which is adapted to cooperate with the toe piece 28 in releasably connecting the forward most end of the boot plate to the ski. The cup-shaped formations 48 on the spring bars are adapted to releasably receive a male plug 50 provided on the toe piece as will be described in more detail later.

Immediately adjacent to the cup-shaped formations 48 on the spring bars 34 and closer to the leading end 40 of the boot plate 26, a relatively shallow recess 52 is formed in the spring bar which tapers forwardly a slight amount to assist in connecting the boot plate to the toe piece, also in a manner to be described hereinafter. Each spring bar is made out of a semi-rigid material such as 7075 aluminum alloy and the forward ends of the spring bar members are adapted to flex laterally outwardly away from the main body portion 34 upon the application of a preselected force which is determined partially by the strength of the material from which the spring bar is made, the location at which the spring bars are connected to the main body 34, the cross sectional configuration of the spring bars, and the thickness of the spring bar members. In other words, if the attachment locations of the spring bars to the main body 34 are positioned in the reaward most openings 54, the distance from the fasteners 44 to the leading end of the spring bar is maximized so that the force necessary to flex the spring bar is minimized. Conversely, by positioning the attachment location in the forward most ones 56 of the openings, the force required to flex the spring bar is maximized.

A heel carriage 58 forms a part of the boot plate 26 and can be seen in FIGS. 1 and 2 to include a pair of side supports which are interconnected by an overcenter heel release mechanism 62 adapted to cooperate with the heel of the ski boot to releasably hold the heel in tight engagement with the boot plate 26. The side supports 60 are integrally connected along their bottom edges by a bottom plate 64 which is adapted to slide along the underside of the main body 32 of the boot plate and each side support has an inwardly directed tab 66 at its leading edge, adapted to overlie the sides 36 of the main body portion of the boot plate so that the main body is confined between the tabs 66 and the bottom plate 64. Each side support member 60 has a plurality of longitudinally aligned apertures 68 extending therethrough which are adapted to be aligned with selected ones of apertures 70 in the sides of the main body 32 of the boot plate. In this manner, the heel carriage can be selectively positioned along the length of the main body 32 through use of a U-shaped retainer spring 72 which lies within the channel formed in the main body and has a pair of outwardly directed pins 74 adapted to extend first through one of the apertures 70 in the main body and subsequently through an aligned aperture 68 in the associated side support member 60 to positively position the heel carriage relative to the main body. It should be appreciated that the spacing between the apertures 70 in the main body and the spacing between the apertures 68 in the side support plates are different, such as, for example, 0.4" spacing between the apertures in the main body and 0.3" spacing between the apertures in the side support plates giving them an adjustment increment of 0.1" so that any sized boot can be correctly fitted on the boot plate as illustrated in FIG. 2.

Each side support plate 60 on the heel carriage 58 has an upstanding leg 76 with an aperture (not seen) in its uppermost end adapted to receive a pivot pin 78 to pivotally secure the heel release mechanism 62 to the side support plates. The lower edges of the legs 76 have inwardly directed tabs 80 adapted to overlie the sides of the main body 32 of the boot plate to support the rearward most ends of the side support plates in a slideable fashion on the sides of the main body.

The heel release mechanism 62 itself is of a conventional type and in the preferred embodiment is merely the heel release mechanism from a Model 99 Look ski binding manufactured by Look S.A. of Nevers, France. Since the heel release mechanism 62 is conventional in nature, it will not be described in detail, but suffice it to say that it is an overcenter spring biased system that is utilized in "step-in" bindings so that a skier can merely step on a projection provided on the lower edge of the heel release mechanism to cause the mechanism to pivot clockwise as viewed in FIGS. 1 and 2 so that the mechanism assumes a substantially vertical orientation when the boot is releasably secured thereby. A predetermined and adjustable vertical pulling force on the heel of the boot will overcome the spring overcenter system in the heel release mechanism to cause the mechanism to pivot counter-clockwise about its connection to the side support plate thereby releasing the heel of the boot in an upward direction so that the entire boot can be freed from the plate binding on which it was releasably secured.

As is well known in the ski industry, however, it is also important in a release binding that the binding be adapted to release upon a lateral force applied to the foot of the skier and as will be described in more detail later, the binding of the present invention is adapted to release in this manner independently from the heel release mechanism which has been described to release only in a vertical direction.

An important feature of the present invention is the provision of an elevator plate 82 pivotally secured to the heel portion or trailing end 84 of the main body 32 of the boot plate so as to be movable between a stowed position beneath the trailing end 84 and a deployed position (FIGS. 9 and 11) extending perpendicularly downwardly away from the trailing end of the main body. The elevator plate 82 is probably best seen in FIG. 15 to comprise a generally flat planar member having a pair of upstanding ears 86 at one end with apertures 88 provided through the ears so that the plate can be pivotally connected to the trailing end of the main body by inserting pivot pins 90 through the ears 86 and one of the aligned pairs of apertures 70 provided in the sides of the main body 34. The end of the elevator plate adjacent the ears is provided with two notched steps 92 so as to define a tab 94 which projects away from this end of the elevator plate for a purpose to be described hereinafter.

The opposite end of the elevator plate is notched so that upstanding side edges 96 of the elevator plate protrude away from this end of the plate so as to define a wide notch 98 in the plate which also serves a function that will be described later. A large generally square shaped opening 100 is provided through the elevator plate 82 and extends substantially from the center of the plate to a location in alignment with the upstanding ears. This opening is partially formed by a U-shaped attachment arm 102 which originally occupied the opening space but which has been bent upwardly through a U-shaped curve to project in the same direction as the tab 94. The end of the attachment arm 102 has a hole 104 therethrough for a purpose to be described later.

The end of the elevator plate which has the notch 98 formed therein, has a generally oval shaped slot 106 passing through the plate which is adapted to cooperate with the heel piece 30 in a manner to be described later to secure the binding in one of the selection elevated positions available. Intermediate the slot 106 and the opening 100, a third opening 108 is provided in the plate 82 which has merely been provided to remove weight from the plate and consequently the binding as is desirable for skiing purposes.

Figure 9:
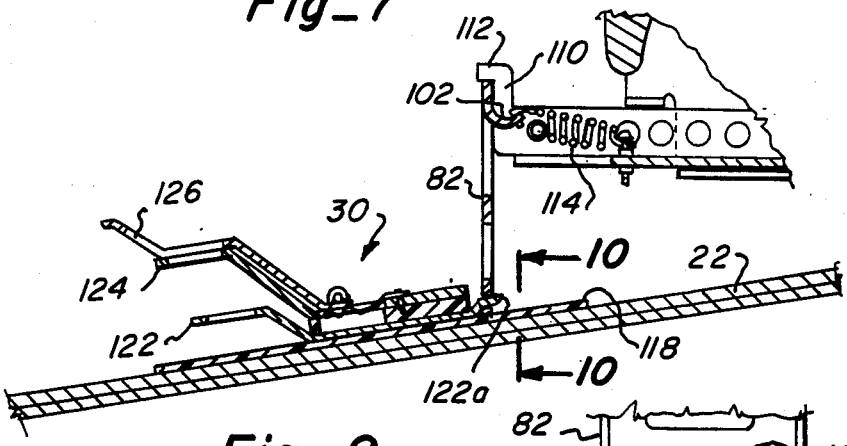
Figure 10:
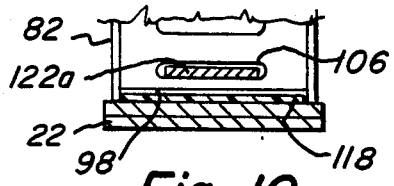
FIG. 10 is a fragmentary view taken along line 10—10 of FIG. 9.

As will be appreciated, the elevator plate 82 is pivotally mounted on the pivot pins 90 for the movement between the stowed and deployed positions and when in the deployed position illustrated in FIGS. 9 and 11, the elevator plate is confined to a perpendicular relationship with the main body 32 of the boot plate by a pair of spaced stops 110 which are connected to the main body by the same pivot pins 90 which mount the elevator plate on the main body. The stops 110, however, do not move relative to the main body 34 due to the fact that they are elongated and overlie a small portion of the bottom of the main body near its trailing end. Each stop 110 has a rearwardly directed tab 112 which is adapted to fit in one of the steps 92 provided in the elevator plate and thereby straddle the tab 94 so that the elevator plate is reinforced and prevented from lateral movement which could otherwise damage and possibly render the binding inoperable for its intended use.

A coil spring 114 is anchored at one end to the opening 104 in the attachment arm 102 and at its opposite end to a bolt 116 passing through a threaded opening in the bottom of the main body 32 of the boot plate. As will be appreciated by reference to FIGS. 6 and 11, the spring 114 cooperates with the elevator plate 82 in establishing an overcenter system to yieldingly retain the elevator plate in either its stowed (FIG. 6) or deployed (FIG. 11) positions since the location at which the spring is connected to the elevator plate is beneath the pivot pins 90 when the elevator plate is in its stowed position and is above the pivot pins 90 when the elevator plate is in its deployed position. It should also be pointed out that the anchor bolt 116 can be advanced any desired distance through the bottom of the main body portion of the boot plate to engage the elevator plate in its stowed position thereby providing a system for regulating the angular relationship of the elevator plate to the main body when the elevator plate is in its stowed position. In this manner, the elevator plate can be made to lie parallel with the upper surface of the ski on which the binding is mounted even though the main body 32 of the boot plate 26 itself may not be parallel. This adjustment is provided since some skiers like the heel of their boot to be elevated a slight amount for alpine skiing while others may not like the same amount of elevation.

Looking now at the heel piece 30 portion of the binding 20 of the present invention, it can be seen in FIGS. 3, 4 and 5 to comprise laminated component parts some of which are moveable relative to the others to enable the heel piece to selectively secure the trailing end of the boot plate 26 to the ski or alternatively to allow the trailing end to pivot freely about the connection of the boot plate to the toe piece 28. The heel piece 30 includes a relatively large rectangularly shaped base plate 118 adapted to overlie and be attached to the top surface of the ski 22, a generally square shaped block member 120 overlying the base plate 118 at approximately its longitudinal center, a slide lock plate 122 which is slidably disposed between the base plate 118 and the block member 120, a top plate 124 secured to the top of the block member 120 and a swing plate 126 pivotally connected to the top plate 124. The entire assembly is secured to the ski by four screws 128 which pass downwardly through the top plate 124, the block 120 and the base plate 118 and these screws defining a passage therebetween in which the slide lock plate 122 is allowed to slide longitudinally of the ski.

The slide lock plate 122 consists of an elongated generally rectangular shaped piece of plate metal having its forward end **122*a* bent upwardly and forwardly to define a space between the forward end of the slide lock plate 122 and the base plate of the heel piece. The trailing end of the slide lock plate is likewise bent upwardly and then rearwardly to define a rearwardly directed horizontal tab 122*b* which extends in spaced parallel relationship to the base plate with the tab 122*b* having a large circular opening 122*c* therethrough for a purpose to be described later. It shoud be appreciated that the base plate 118 of the heel piece 30 extends forwardly along the ski a sufficient distance to underlie the trailing end of the boot plate 26. With the elevator plate 82 of the boot plate in its stored position, as illustrated in FIG. 1, it will be appreciated that the tab 94 on the elevator plate extends rearwardly toward the heel piece and the forward end 122*a* of the slide lock plate is adapted to be moved forwardly into an overlying relationship with the tab 94 to confine the tab between the slide lock plate and the base plate thereby preventing the trailing end of the boot plate from being lifted or pivoted vertically upwardly away from the ski. In other words, the slide lock plate 122 in this locked position secures the trailing end of the boot plate so that the binding is postured for alpine skiing. As will be readily apparent, however, by sliding the slide lock plate 122 rearwardly, the forward end 122***a* of the slide lock plate is slid behind the tab 94 on the elevator plate of the boot plate so that the trailing end of the boot plate is free to be moved vertically upwardly and pivoted about the toe piece 30.

The top plate portion 124 of the heel piece is configured similarly to the slide lock plate 122 except that it is wider so as to define a base portion 124*a* overlying the block 120 and having a rearward angular extension portion 124*b* which angles upwardly and rearwardly away from the base portion to define a horizontal tab portion 124*c* extending rearwardly from the angular extension 124*b*. The tab 124*c* also has a circular aperture 124*d* therethrough and as will be appreciated, the top plate 124 is positively fixed relative to the ski. In this manner, the slide lock plate 122 can be slid forwardly or rearwardly by inserting the pointed tip of a ski pole through the aperture 124*d* in the tab on the top plate 124 and into the opening 122*c* on the tab 122*b* of the slide lock plate and then pivoting the ski pole to cause the slide lock plate 122 to slide forwardly or rearwardly as desired and as illustrated in FIG. 3. This system for selectively securing and releasing the heel of the boot plate 26 is very easily operable and also prevents the buildup of ice which might otherwise cause a jamming of the system. It should also be appreciated that the trailing end of the boot plate 26 can slide laterally out from under the slide lock plate 122 if enough lateral force is applied to the boot to allow the boot plate to snap off the toe piece 28 and be released from the ski. It is important to note that this lateral release is completely independent from the vertical release described previously.

Figure 7:
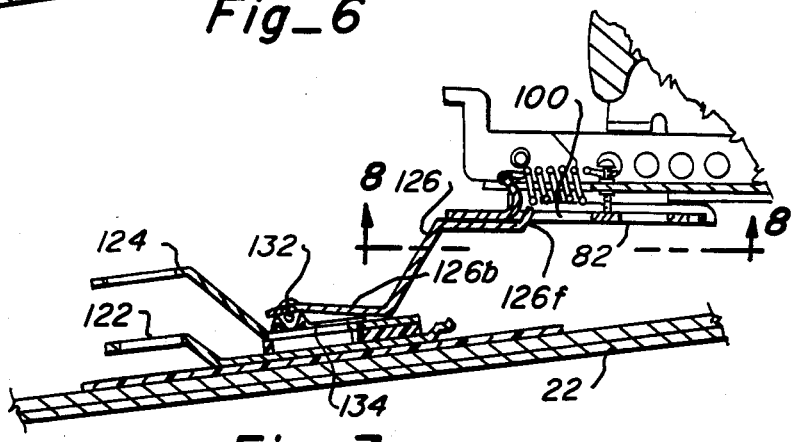

The base portion 124*a* of the top plate 124 has a pair of upstanding ears 130 near its rearward most end and the ears 130 are adapted to receive and retain a laterally extending pivot rod 132 which passes through a looped portion on a confined end 126*a* of the swing plate 126. The looped portion of the swing plate 126 defines a bearing about which the swing plate can pivot between an inoperative position as illustrated in FIG. 1 and an operative position as illustrated in FIGS. 7 and 11. The swing plate, is of generally S-shaped configuration so that a first portion 126*b* of the swing plate adjacent to the confined end 126*a* can lie over the reardwardly angular extension portion 124*b* of the top plate 124, an intermediate portion 126*c* can overlie the rearwardly projecting horizontal tab of the top plate and a distal end 126*e* can form a rearward and upward projection from the intermediate portion 126*b*. The intermediate portion 126*b* has an aperture 126*e* therethrough so that when the swing plate 126 is in its inoperative position as illustrated in FIG. 1, the aperture 126*e* will overlie the aperture 124*d* in the rearwardly directed tab of the top plate again allowing the passage of the tip of a ski pole for operation of the slide lock plate 122. A horizontal tab 126*f* of a narrower width than the remainder of the swing plate projects rearwardly in substantially parallel relationship with the rearwardly directed tabs of the top plate and slide lock plate and serves a function to be described hereinafter.

A leaf spring 134, as best seen in FIG. 5, is secured to the base portion 124*a* of the top plate 124 immediately forwardly of an opening 136 provided through the top plate and an opening 137 in the block 120. The leaf spring extends rearwardly so as to underlie the swing plate at its confined end 126*a*. The leaf spring 134 has an upwardly opening channel 134*a* formed therein so as to engage the swing plate 126 at spaced locations beneath the confined end 126*a* and in this manner will yieldingly retain the swing plate in its inoperative position as shown in FIG. 5 and will also yieldingly retain the swing plate in its operative position as probably best illustrated in FIG. 7. The swing plate can obviously be pivoted about the pivot rod 132 between the operative and inoperative positions by overcoming the bias of the leaf spring 134 which tends to hold the swing plate in either its inoperative or operative positions.

Looking next at the toe piece 28 which is fully described in U.S. Pat. No. 4,002,354 issued Jan. 11, 1977, which is of common ownership with the subject application and is hereby incorporated by reference, it can be seen to consist of a solid block of material, such as aluminum, plastic or the like having a relatively thick center portion 30*a* and thin forward and rearward plate-like portions 30*b* having openings therethrough through which screw-type fasteners 138 are passed to secure the toe piece to the ski. The toe piece has a transversely extending passage (not seen) through the relatively thick portion 30*a* thereof and the pair of laterally extending male plugs 50 are seated in this passage. Each plug 50 has a serrated cylindrical body portion (not seen) which is received in the passage and an enlarged generally hemispherical head protuding laterally away from the side of the block. The plugs are formed to be press fitted into the passage in a conventional manner for retention.

The rounded head on each male plug 50 serves as a cam surface and is adapted to be releasably received in the inwardly opening cup 48 of the associated spring bar 34 to releasably and pivotally connect the forward end of the boot plate to the toe piece. When connecting the boot plate to the laterally extending plugs 50, one plug is seated in its associated inwardly opening cup 48 and the boot plate is then rotated about that seating until the rounded head on the other male plug slides into the recess 52 on the opposite spring bar. Rotation of the boot plate then will cause the leading end of the associated spring bar to flex outwardly until the male plug snaps into the associated inwardly opening cup where it also becomes releasably seated. As will be appreciated, the male plugs define an axis which extends transversely of the ski and about which the boot plate 26 can pivot so long as the trailing end of the boot plate is not confined by the heel piece. Movement of the spring bars 34 relative to the male plugs 50, other than the pivotal movement about the afore-defined transverse axis, will cause the rounded head of the male plugs to cam the associated spring bar member outwardly and if the force is great enough, the spring bar can be cammed outwardly until the associated male plug pops out of the inwardly opening cup 48 in the spring bar in which it was seated thereby releasing the boot plate from the toe piece. As mentioned previously, by positioning the connection locations of the spring bars to the base plate in selected ones of the openings 54 and 56 in the spring bar members, the force required to snap the spring bars off the male plug can be regulated.

The benefits provided by the binding which has thus far been described, are best illustrated by reference to the operation of the binding. First of all, as has been discussed previously, the boot plate 26 is releasably but pivotally connected to the toe piece 28 and can pivot about the toe piece if the trailing end of the boot plate is not confined adjacent to the top surface of the ski. Of course, the slide lock plate 122 on the heel piece 28 is designed to either secure or release the trailing end of the boot plate and accordingly the position of the slide lock plate determines whether or not the boot plate is allowed to pivot about the toe piece. When alpine skiing, it is desirable to confine the heel of the boot plate adjacent to the top surface of the ski but for cross-country skiing or touring, it is normally desirable to release the heel so that the foot of the skier, while being confined to the boot plate, is still allowed to move in a walking motion so that the cross-country skiing is rendered easier.

It is sometimes desirable, however, to prevent the heel of the boot from returning completely to the ski when cross-country skiing as it requires additional energy to lift the foot from a horizontal position as compared to lifting the foot from an acutely inclined position. Also, when climbing inclines and particularly steep incline such as might be facilitated by placing climbing skins or other mechanical devices on the bottom of the ski, it is even more desirable to prevent the heel of the boot from returning to the ski. When climbing these inclined surfaces, it is desirable to possibly allow the foot to return to a horizontal orientation but not to a position which is beyond horizontal wherein the bottom of the boot is parallel with the inclined surface on which the skier is climbing. Accordingly, the binding of the present invention has been designed to establish four different positions to which the heel of the boot can return when the binding is in a cross-country mode with the trailing end of the boot plate 26 released from the heel piece 30.

Figure 6:
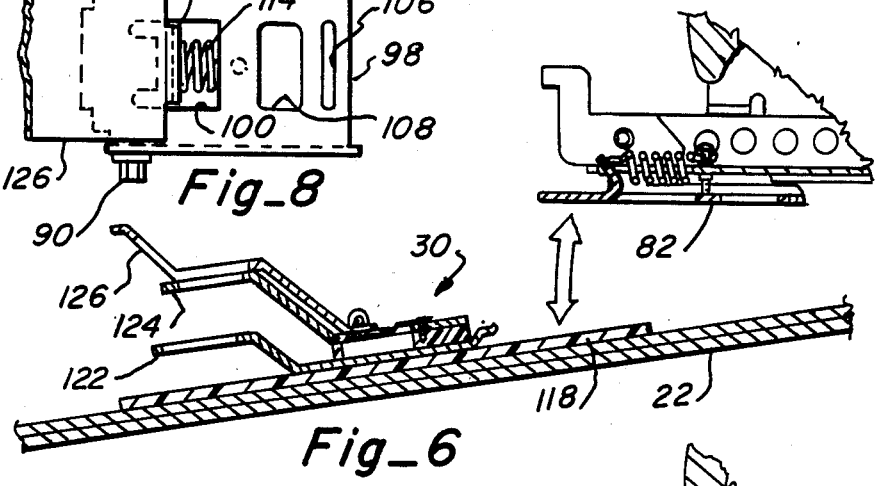

The first position is illustrated in FIG. 6 and it will there be appreciated that the elevator plate 82 is in its stored position beneath the main body 32 of the boot plate and the heel piece 30 has all component parts retracted so as to allow freedom of movement of the boot plate from a position immediately adjacent the top surface of the ski to any angular relationship as formed from the pivotal connection of the boot plate to the toe piece 28.

A second position is illustrated in FIG. 9 wherein the elevator plate 82 has been moved to its deployed position so as to form a perpendicular downward extension from the trailing end of the boot plate so that the notch 98 in the end of the elevator plate straddles the base plate portion 118 of the heel piece when the heel is lowered as far as it will go. The notch 98, of course, in the elevator plate gives lateral stability to prevent damage to the binding. It should be appreciated, that with the slide lock plate 122 retracted rearwardly in an inoperative position, the boot plate 26 is free to pivot about the toe piece 28 but the slide lock plate can be slid forwardly into its operative position to slide into the oval slot 106 in the elevator plate and lock the boot plate in the angular orientation illustrated in FIG. 9. This elevated and locked position is sometimes desirable when climbing very steep hills.

A third position is obtained by placing the elevator plate 82 in its stored position and moving the swing plate 126 on the heel piece into its forwardly directed operative position as illustrated in FIG. 7 so that the distal end **126*d* of the swing plate underlies the training end of the elevator plate and the horizontal tab 126*f* on the swing plate projects upwardly into the opening 100 provided in the elevator plate to again provide lateral support. It should be appreciated that this third position is intermediate the first two positions insofar as the angular orientation of the boot relative to the ski is concerned. It should also be appreciated, however, that in this third position, the trailing end of the boot plate is free to pivot about the toe piece, but cannot return completely to the ski, only to an elevated position intermediate that obtainable in the first and third positions illustrated in FIGS. 6 and 9**, respectively.

The fourth position obtainable with the binding of the present invention is illustrated in FIG. 11 and here it will be appreciated that the elevator plate 82 is moved into its deployed position and the swing plate 126 is moved into its forward operative position so that the lower notched end of the elevator plate can engage and straddle the distal end **126*d* of the swing plate. Again, the notch 98 in the lower end of the elevator plate gives lateral stability so that the skier's foot is not allowed to fall to one side or the other placing a strain on the releasable connection of the base plate to the toe piece. The orientation of the parts of the binding illustrated in FIG. 11** is obviously utilized for climbing steeper hills than the orientations previously described and establishes a larger angular relationship of the ski boot to the ski than in the three previously defined orientations.

Another desirable feature of the invention which is not illustrated in any of the views of the drawing, but which will be appreciated from an understanding of the invention is the fact that the elevator plate 82 is only yieldingly retained in its stored position and can therefore pivot slight amounts about its pivotal connection to the main body under minor pressures. Accordingly, if the ski becomes excessively bowed in an upwardly concave direction and the trailing end of the boot plate 26 is moved downwardly into engagement with the upper surface of the ski, the elevator plate itself will pivot slightly in a clockwise direction as viewed in FIG. 6, for example, so that the elevator plate conforms with the angle of the top surface of the ski and does not, therefore, possibly jam into the heel piece 30 which would have been upwardly relative to its position illustrated in FIG. 6 if the ski was bowed as described.

Although the present invention has been described with a certain degree of particularity, it is understood that the present disclosure has been made by way of example, and that changes in detail or structure may be made without departing from the spirit of the invention, as defined in the appended claims.

I claim:

1. A binding for releasably connecting a boot to a ski comprising in combination:

a boot plate selectively securable to the boot, toe piece means for pivotally connecting a leading end of said boot plate to a ski such that the boot plate can pivot about the leading end thereof by lifting and lowering a trailing end of the boot plate, heel piece means adapted to operatively engage the trailing end of said boot plate to hold said trailing end adjacent to the ski in one position and in a second disengaged position allow the trailing end to pivot about said toe piece, and swing plate means mounted on said heel piece means for movement between a first position underlying the trailing end of said boot plate to a second position in alignment with said heel piece means, said swing plate means in its first position being adapted to prevent the boot plate from extending in a parallel relationship to the ski and in its second position being completely unobstructive of the pivotal movement of the boot plate about the toe piece.

2. The binding of claim 1 wherein said swing plate means is pivotally mounted on said heel piece means.

3. The binding of claim 1 further including elevator means mounted on said boot plate for movement between a stored position beneath the boot plate to a deployed position projecting downwardly from the boot plate, said elevator means in the deployed position being adapted to prevent the boot plate from extending in a parallel relationship to the ski.

4. A binding for releasably connecting a boot to a ski, comprising in combination:

a boot plate selectively securable to the boot, toe piece means for pivotally connecting a leading end of said boot plate to a ski such that the boot plate can pivot about the leading end thereof by lifting and lowering a trailing end of the boot plate, heel piece means adapted to operatively engage the trailing end of said boot plate to hold said trailing end adjacent to the ski in one position and in a second disengaged position allow the trailing end to pivot about said toe piece, swing plate means mounted on said heel piece means for movement between a first position underlying the trailing end of said boot plate to a second position in alignment with said heel piece means, said swing plate means in its first position being adapted to prevent the boot plate from extending in a parallel relationship to the ski and in its second position being completely unobstructive of the pivotal movement of the boot plate about the toe piece means, elevator means being mounted on the boot plate for movement between a stored position beneath the boot plate and a deployed position projecting downwardly from the boot plate, said elevator means in the deployed position being adapted to prevent the bootplate from extending in a parallel relationship to the ski, and wherein the swing plate means and the elevator means are operatively cooperative in establishing a plurality of positions of angular relationship between the boot plate and the ski.

5. The binding of claim 4 further including means on said heel piece for selectively locking the boot plate in at least one of said positions of angular relationship.

6. A binding for releasably connecting a boot to a ski comprising in combination:

a boot plate selectively securable to the boot, toe piece means for pivotally connecting a leading end of said boot plate to a ski such that the boot plate can pivot about the leading end thereof by lifting and lowering a trailing end of the boot plate, heel piece means adapted to operatively engage the trailing end of said boot plate to hold said trailing end adjacent to the ski in one position and in a second disengaged position, allow the trailing end to pivot about said toe piece means, and elevator means mounted on said boot plate for movement between a stored position beneath the boot plate and a deployed position projecting downwardly from the boot plate, said elevator means in the deployed position being adapted to prevent the boot plate from extending in a parallel relationship to the ski, and further including means on the elevator means to which the heel piece means can be selectively connected to secure the boot plate to the ski when the elevator means is in its deployed position.

* * * * *